US008937434B2

(12) United States Patent
Datta

(10) Patent No.: US 8,937,434 B2
(45) Date of Patent: Jan. 20, 2015

(54) METHOD AND APPARATUS FOR ADJUSTING LIGHT OUTPUT RANGE OF SOLID STATE LIGHTING LOAD BASED ON MAXIMUM AND MINIMUM DIMMER SETTINGS

(75) Inventor: Michael Datta, Brookline, MA (US)

(73) Assignee: Koninklijke Philips N.V., Eindhoven (NL)

( * ) Notice: Subject to any disclaimer, the term of this patent is extended or adjusted under 35 U.S.C. 154(b) by 74 days.

(21) Appl. No.: 13/641,982

(22) PCT Filed: Apr. 22, 2011

(86) PCT No.: PCT/IB2011/051773

§ 371 (c)(1),
(2), (4) Date: Oct. 18, 2012

(87) PCT Pub. No.: WO2011/135504

PCT Pub. Date: Nov. 3, 2011

(65) Prior Publication Data

US 2013/0033193 A1 Feb. 7, 2013

Related U.S. Application Data

(60) Provisional application No. 61/328,247, filed on Apr. 27, 2010.

(51) Int. Cl.
*H05B 37/02* (2006.01)
*H05B 33/08* (2006.01)

(52) U.S. Cl.
CPC ..... *H05B 33/0815* (2013.01); *H05B 33/0845* (2013.01)
USPC ..... 315/200 R; 315/307; 315/291; 315/209 R

(58) Field of Classification Search
CPC ..... H05B 41/16
USPC ..... 315/279, 209, 291, 200 R, 246, 268, 276
See application file for complete search history.

(56) References Cited

U.S. PATENT DOCUMENTS 6,016,038 A 1/2000 Mueller et al.
6,211,626 B1 4/2001 Lys et al.
7,256,554 B2 8/2007 Lys (Continued)

OTHER PUBLICATIONS

Author: Microchip, Title: PIC12F683, Plublisher: Dec. 8, 2006.*

(Continued)

*Primary Examiner* — Douglas W Owens
*Assistant Examiner* — Wei Chan
(74) *Attorney, Agent, or Firm* — Yuliya Mathis

(57) ABSTRACT

A method is provided for controlling a power converter (220) to provide a uniform dimming range to a solid state lighting load (240) independent of a type of dimmer. The method includes detecting maximum and minimum phase angles of a dimmer (204) connected to the power converter (220) during operation of the solid state lighting load (240), and dynamically adjusting an output power of the power converter based on the detected maximum and minimum phase angles of the dimmer. The adjusted output power of the power converter adjusts a high end level of light output by the solid state lighting load at the maximum phase angle to match a predetermined high end value and adjusts a low end level of light output by the solid state lighting load at the minimum phase angle to match a predetermined low end value.

14 Claims, 7 Drawing Sheets

(56) References Cited

U.S. PATENT DOCUMENTS

| | | | | |
|---|---|---|---|---|
| 8,102,167 | B2 * | 1/2012 | Irissou et al. | 323/300 |
| 8,378,588 | B2 * | 2/2013 | Kuo et al. | 315/291 |
| 2007/0152926 | A1 * | 7/2007 | Kwon | 345/82 |
| 2009/0184662 | A1 | 7/2009 | Given et al. | |
| 2009/0295300 | A1 * | 12/2009 | King | 315/209 R |
| 2010/0109548 | A1 * | 5/2010 | Matsuda | 315/279 |
| 2010/0181935 | A1 * | 7/2010 | Wu | 315/307 |
| 2011/0037399 | A1 * | 2/2011 | Hung et al. | 315/219 |
| 2012/0025724 | A1 * | 2/2012 | Melanson et al. | 315/201 |
| 2012/0091907 | A1 * | 4/2012 | Setomoto et al. | 315/200 R |
| 2013/0257280 | A1 * | 10/2013 | Myers et al. | 315/122 |

OTHER PUBLICATIONS

D. Rand et al: "Issues, Models and Solutions for Triac, Modulated Phase Dimming of LED Lamps", Power Electronics Specialists Conference, 2007, IEEE, Piscataway, NJ, USA, Jun. 17, 2007, pp. 1398-1404, XP031218489.

* cited by examiner

METHOD AND APPARATUS FOR ADJUSTING LIGHT OUTPUT RANGE OF SOLID STATE LIGHTING LOAD BASED ON MAXIMUM AND MINIMUM DIMMER SETTINGS

TECHNICAL FIELD

The present invention is directed generally to control of solid state lighting fixtures. More particularly, various inventive methods and apparatuses disclosed herein relate to adjusting a light output range of a solid state lighting system to compensate for dimming ranges of different dimmers.

BACKGROUND

Digital or solid state lighting technologies, i.e., illumination based on semiconductor light sources, such as light-emitting diodes (LEDs), offer a viable alternative to traditional fluorescent, high-intensity discharge (HID), and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications.

Some of the fixtures embodying these sources feature a lighting module, including one or more LEDs capable of producing white light and/or different colors of light, e.g., red, green and blue, as well as a controller or processor for independently controlling the output of the LEDs in order to generate a variety of colors and color-changing lighting effects, for example, as discussed in detail in U.S. Pat. Nos. 6,016,038 and 6,211,626. LED technology includes line voltage powered luminaires, such as the ESSENTIALWHITE series, available from Philips Color Kinetics. Such luminaires may be dimmable using trailing edge dimmer technology, such as electric low voltage (ELV) type dimmers for 120 VAC line voltages (or input mains voltages).

Many lighting applications make use of dimmers. Conventional dimmers work well with incandescent (bulb and halogen) lamps. However, problems occur with other types of electronic lamps, including compact fluorescent lamp (CR), low voltage halogen lamps using electronic transformers and solid state lighting (SSL) lamps, such as LEDs and OLEDs. Low voltage halogen lamps using electronic transformers, in particular, may be dimmed using special dimmers, such as ELV type dimmers or resistive-capacitive (RC) dimmers, which work adequately with loads that have a power factor correction (PFC) circuit at the input.

Conventional dimmers typically chop a portion of each waveform of the input mains voltage signal and pass the remainder of the waveform to the lighting fixture. A leading edge or forward-phase dimmer chops the leading edge of the voltage signal waveform. A trailing edge or reverse-phase dimmer chops the trailing edges of the voltage signal waveforms. Electronic loads, such as LED drivers, typically operate better with trailing edge dimmers.

Unlike incandescent and other resistive lighting devices which respond naturally without error to a chopped sine wave produced by a phase-cutting dimmer, LEDs and other solid state lighting loads may incur a number of problems when placed on such phase chopping dimmers, such as low end drop out, triac misfiring, minimum load issues, high end flicker, and large steps in light output.

In addition, dimming ranges (i.e., the range between minimum and maximum phase angles of a dimmer) may differ from dimmer to dimmer, depending on various factors, such as the model and/or type of dimmer. For example, among conventional dimmers, the root mean square (RMS) voltage output by the dimmer and seen at an input of a power converter may vary from about 45 percent to about 20 percent of the full unchopped mains at the minimum dimmer settings (corresponding to minimum dimmer phase angles and lowest levels of light output), and from about 75 percent to about 95 percent of the full unchopped mains at the maximum dimmer settings (corresponding to maximum dimmer phase angles and highest levels of light output). These differences result in various dimming levels and dimming ranges, depending on the dimmer.

FIGS. 1A and 1B depict representative chopped waveforms of a rectified input mains voltage received by a power converter from different types of dimmers (Dimmer A and Dimmer B), respectively set at their minimum dimmer settings. As shown in FIGS. 1A and 1B, the phase angle of Dimmer A at its minimum dimmer setting is larger than the phase angle of Dimmer B at its minimum dimmer setting. For example, Dimmer A may be a 6615-POW dimmer and Dimmer B may be a DVELV-303P dimmer, both available from Leviton Manufacturing Co., in which case Dimmer A will dim down only to about 17 percent, while Dimmer B will dim down to about 6 percent. The phase angle of each dimmer corresponds to an "on-time," which is the amount of time each chopped signal waveform of the rectified input mains voltage is non-zero. The on-time may be determined, for example, by the amount of time the electronic switch of the respective dimmer is "on" (i.e., enabling current to flow to power converter). Referring to FIGS. 1A and 1B, the on-time $Ton_a$ of Dimmer A is greater than on-time $Ton_b$ of Dimmer B.

Accordingly, Dimmer A provides a larger RMS voltage to the input to the power converter than Dimmer B, resulting in more light output from the solid state lighting load when Dimmer A is set at its minimum dimmer setting than when Dimmer B is set at its minimum dimmer setting. Because of the non-linear nature of the human eye's response to light intensity, the difference between the two lowest dimmer setting intensities will be dramatic. A similar situation exists with respect to the maximum dimmer settings of Dimmer A and Dimmer B.

SUMMARY

The present disclosure is directed to inventive methods and devices for determining minimum and maximum dimmer phase angles and adjusting power output to a solid state lighting load based on the maximum and minimum dimmer phase angles to control the amount of light output by the solid state lighting load in response to the maximum and minimum dimmer phase angles.

Generally, in one aspect, a method is provided for controlling a power converter to provide a uniform dimming range to a solid state lighting load independent of a type of dimmer. The method includes determining maximum and minimum phase angles of a dimmer connected to the power converter during operation of the solid state lighting load, and dynamically adjusting an output power of the power converter based on the detected maximum and minimum phase angles of the dimmer. The adjusted output power of the power converter adjusts a high end level of light output by the solid state lighting load at the maximum phase angle to match a predetermined high end value, and adjusts a low end level of light output by the solid state lighting load at the minimum phase angle to match a predetermined low end value.

In another aspect, a method provides a uniform dimming range of a solid state lighting load for multiple different types of dimmers. The method includes initially setting a minimum phase angle corresponding to a minimum dimmer setting and a maximum phase angle corresponding to maximum minimum dimmer setting; detecting a dimmer phase angle based on a rectified input mains voltage; determining whether the detected phase angle is less than the initial minimum phase angle; and setting the detected phase angle as the minimum phase angle when the detected phase angle is less than the initial minimum phase angle. The method further includes determining whether the detected phase angle is greater than the initial maximum phase angle; and setting the detected phase angle as the maximum phase angle when the detected phase angle is greater than the initial maximum phase angle. A light output range function is determined from the minimum phase angle and the maximum phase angle for determining a value of a power control signal. The power control signal controls an output power delivered by a power converter to the solid state lighting load, such that the solid state lighting load outputs a predetermined minimum light level in response to the minimum phase angle and outputs a predetermined maximum light level in response to the maximum phase angle.

In another aspect, a system is provided for controlling power delivered to a solid state lighting load. The system includes a power converter and a dimmer phase angle detection circuit. The power converter is configured to deliver a predetermined nominal power to the solid state light load in response to a rectified input voltage originating from voltage mains. The dimmer phase angle detection circuit is configured to determine whether a dimmer is connected between the voltage mains and the power converter, to generate a power control signal having a first value when the dimmer is present and having a second value when the dimmer is not present, and to provide the power control signal to the power converter. The power converter increases output power by a compensation amount in response to the first value of the power control signal, the increased output power being equal to the nominal power.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., LED white lighting fixture) may include a number of dies which respectively emit different spectra of electroluminescence that, in combination, mix to form essentially white light. In another implementation, an LED white lighting fixture may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white light LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

The term "lighting fixture" or "luminaire" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, microcontrollers, application specific integrated circuits (ASICs), and field-programmable gate arrays (FPGAs).

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same or similar parts throughout the different views. Also, the drawings are not necessarily to scale, emphasis instead generally being placed upon illustrating the principles of the invention.

DETAILED DESCRIPTION

In the following detailed description, for purposes of explanation and not limitation, representative embodiments disclosing specific details are set forth in order to provide a thorough understanding of the present teachings. However, it will be apparent to one having ordinary skill in the art having had the benefit of the present disclosure that other embodiments according to the present teachings that depart from the specific details disclosed herein remain within the scope of the appended claims. Moreover, descriptions of well-known apparatuses and methods may be omitted so as to not obscure the description of the representative embodiments. Such methods and apparatuses are clearly within the scope of the present teachings.

Applicants have recognized and appreciated that it would be beneficial to provide a circuit capable of adjusting power output by power converter to a solid state lighting load to compensate for differences in maximum and minimum dimming levels provided by different dimmers, thus providing uniform levels of high end and low end light output by the solid state lighting load.

Generally, it is desirable to have the same amount of light output from a solid state lighting load at maximum and minimum dimmer settings, respectively, regardless of type of dimmer (e.g., model and manufacturer) to which the solid state lighting load is connected. In various embodiments, maximum and minimum phase angles of a particular dimmer are detected during operation of the solid state lighting load. The output power of a power converter driving the solid state lighting load is then dynamically adjusted, based on the detected maximum and minimum dimmer phase angles, so that the level of light output by the solid state lighting load at the maximum dimmer phase angle is a predetermined high end value and the level of light output by the solid state lighting load at the minimum dimmer phase angles is a predetermined low end value.

Figure 2:
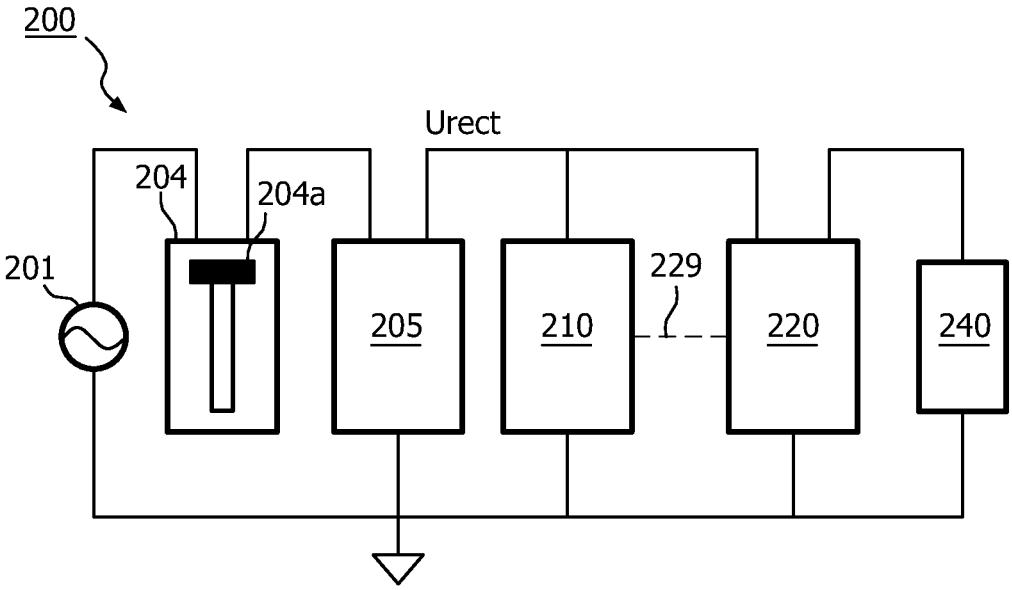
FIG. 2 is a block diagram showing a dimmable lighting system, according to a representative embodiment.

FIG. 2 is a block diagram showing a dimmable lighting system, including a dimmer, dimmer phase angle detection circuit, a power converter and a solid state lighting fixture, according to a representative embodiment.

Referring to FIG. 2, lighting system 200 includes dimmer 204 and rectification circuit 205, which provide a (dimmed) rectified voltage Urect from voltage mains 201. The voltage mains 201 may provide different unrectified input mains voltages, such as 100 VAC, 120 VAC, 230 VAC and 277 VAC, according to various implementations. The dimmer 204 is a phase chopping dimmer, for example, which provides dimming capability by chopping trailing edges (trailing edge dimmer) or leading edges (leading edge dimmer) of voltage signal waveforms from the voltage mains 201 in response to vertical operation of its slider 204*a*. For purposes of discussion, it is assumed that the dimmer 204 is a trailing edge dimmer.

Generally, the magnitude of the rectified voltage Urect is proportional to a phase angle or level of dimming set by the dimmer 204, such that a phase angle corresponding to a lower dimmer setting results in a lower rectified voltage Urect. In the depicted example, it may be assumed that the slider 204*a* is moved downward to lower the phase angle, reducing the amount of light output by solid state lighting load 240, and is moved upward to increase the phase angle, increasing the amount of light output by the solid state lighting load 240. Therefore, the least dimming occurs when the slider 204*a* is at the top position (as depicted in FIG. 2), and the most dimming occurs when the slider 204*a* is at its bottom position.

The lighting system 200 further includes dimmer phase angle detection circuit 210 and power converter 220. The dimmer phase angle detection circuit 210 is configured to determine a phase angle (dimming level) of the representative dimmer 204 based on the rectified voltage Urect, and to adjust dynamically an operating point of the power converter 220 based, in part, on the determined phase angle, using a power control signal. The power converter 220 receives the rectified voltage Urect from the rectification circuit 205 and the power control signal via control line 229, and outputs a corresponding DC voltage for powering the solid state lighting load 240. The power converter 220 converts between the rectified voltage Urect and the DC voltage based on at least the magnitude of the rectified voltage Urect and the value of the power control signal received from the dimmer phase angle detection circuit 210. DC voltage output by the power converter 220 thus reflects the rectified voltage Urect and the dimmer phase angle applied by the dimmer 204. In various embodiments, the power converter 220 operates in an open loop or feed-forward fashion, as described in U.S. Pat. No. 7,256,554 to Lys, for example, which is hereby incorporated by reference.

In various embodiments, the power control signal may be a pulse width modulation (PWM) signal, for example, which alternates between high and low levels in accordance with a selected duty cycle. For example, the power control signal may have a high duty cycle (e.g., 76 percent) corresponding to a high end on-time of the dimmer 204, and a low duty cycle (e.g., 12 percent) corresponding to a low end on-time of the dimmer 204. When the dimmer 204 is set in between the maximum and minimum phase angles, the dimmer phase angle detection circuit 210 further determines a duty cycle of the power control signal that specifically corresponds to the detected dimmer phase angle, determined in accordance with a function adjusted for the maximum and minimum phase angles, as discussed below.

The dimmer 204 may be one of a variety of types of phase chopping dimmers compatible with the solid state lighting load 240, e.g., available from various manufacturers. Generally, each of the different types of dimmers provides different predetermined maximum and minimum phase angles corresponding to the highest and lowest dimmer settings. In other words, the different types of dimmers have different values for the high end on-times at maximum dimmer settings and for the low end on-times at minimum dimmer settings, respectively, of the chopped sine waves, where "on-time" is the amount of time each chopped signal waveform of the rectified input mains voltage is non-zero, as discussed above. Thus, each dimmer phase angle has a corresponding on-time and vice versa. In a conventional lighting system, the different on-time values of the different types of dimmers translate into different levels of light and different dimming ranges output by the solid state lighting load 240 in response to what otherwise appear to be the same dimmer settings.

However, according to various embodiments, the dimmer phase angle detection circuit 210 executes an algorithm to detect the maximum phase angle (corresponding to the high end on-time) and the minimum phase angle (corresponding to the low end on-time) of the particular dimmer 204, and to adjust the power control signal, so that the high end and low end output power delivered by the power converter 220 to the solid state lighting load 240 in response to the maximum and minimum phase angles of the dimmer 204 is the same, regardless of the dimmer type. Accordingly, the levels of light output by the solid state lighting load 240 are likewise the same at the maximum and minimum phase angles of the dimmer 204, regardless of the dimmer type. Therefore, the high end and low end light output levels are set independently of the type of dimmer and the dimmer's actual maximum and minimum phase angles.

For example, when one type of dimmer has a longer high end on-time than another type of dimmer, the dimmer phase angle detection circuit 210 will tune the power control signal such that light output by the solid state lighting load 240 at the maximum setting of both dimmers is the same. Similarly, when one type of dimmer has a shorter low end on-time than another type of dimmer, the dimmer phase angle detection circuit 210 will tune the power control signal such that the light output by the solid state lighting load 240 at the minimum setting of both dimmers is the same.

Figure 3:
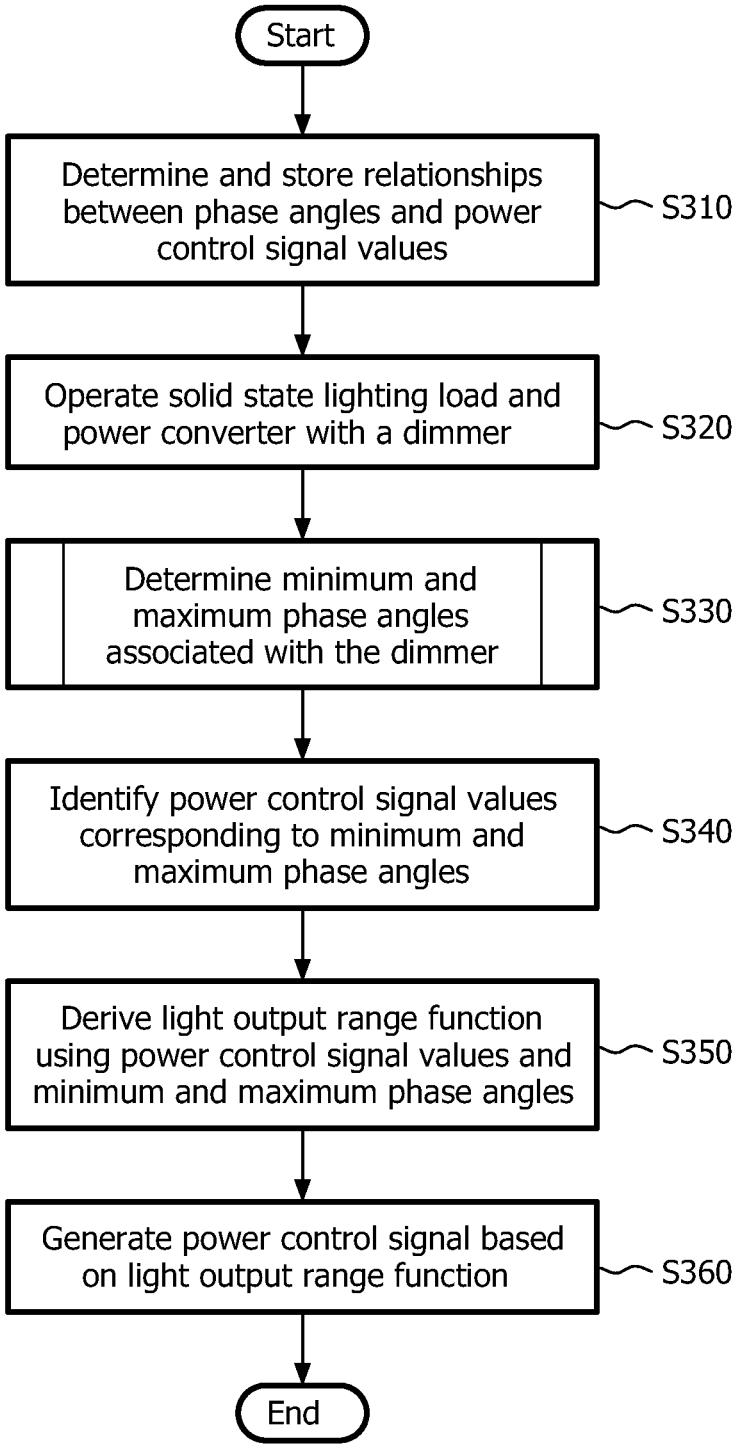
FIG. 3 is a flow diagram showing a process of controlling an amount of power delivered by a power converter to a solid state lighting load, according to a representative embodiment.

FIG. 3 is a flow diagram showing a process of controlling an amount of power delivered by a power converter to a solid state lighting load, according to a representative embodiment. The process may be implemented, for example, by firmware and/or software executed by dimmer phase angle detection circuit 210 shown in FIG. 2, or by microcontroller 615 of FIG. 6, discussed below.

In block S310, relationships are initially determined between various phase angles (dimmer on-times) and power control signal values for providing the desired high end and low end levels of light output by the solid state lighting load 240, when the dimmer 204 is set to the maximum and minimum dimmer settings, respectively. The relationships are stored for future access by the dimmer phase angle detection circuit 210, in order for the dimmer phase angle detection circuit 210 to determine an appropriate function defining a curve corresponding to a light output range of the solid state lighting load 240 based on maximum and minimum dimmer phase angles and associated power control signal values, and to compute power control signal values corresponding to intermediate dimmer phase angles based on the function, as discussed below. For example, the dimmer on-times and associated power control signal values may be used to populate tables corresponding to the maximum and minimum dimmer settings, or may be saved in a relational database, although other means of storing the dimmer on-times and associated power control signal values may be incorporated without departing from the scope of the present teachings.

Initially, the desired high end and low end light output levels (e.g., indicated in lumens) are selected to be output by solid state lighting load 240 at the maximum and minimum dimmer settings, respectively. For example, a light output level of 500 lumens may be selected as the high end level and a light output level of 25 lumens may be selected as the low end light level. For the selected high end light level, a value of the power control signal is determined for each of multiple possible high end on-times (maximum phase angles) corresponding to various types of dimmers, where each power control signal value sets an operating point of the power converter 220 to drive the solid state lighting load 240 to output 500 lumens in response to the high end on-time. Likewise, for the selected minimum light level, a value of the power control signal value is determined for each of multiple possible low end on-times (minimum phase angles) corresponding to the various types of dimmers, where each power control signal value sets an operating point of the power converter 220 to drive the solid state lighting load 240 to output 25 lumens in response to the low end on-time.

According to various embodiments, the power control signal values may be determined according to a variety of means, without departing from the scope of the present teachings. For example, the determined value may be a percentage of the maximum possible value of the power control signal. Also, the power control signal may have a percentage duty cycle, as discussed below, which varies from 100 percent to zero percent, in which case the determined power control signal value may be a percentage duty cycle within this range. The power control signal values may be determined empirically, for example, at the design, manufacturing and/or installation stage. For example, the on-times and power control signal of a particular dimmer may be varied to find the power control signal values at the maximum and minimum dimmer phase angles needed for the solid state lighting load 240 to output the desired lumens. Alternatively, the power control signal values may be determined theoretically, as would be apparent to one of ordinary skill in the art, without departing from the scope of the present teachings.

In various embodiments, the dimmer on-times and corresponding power control signal values for generating the high end light output level may populate a first look-up table, and the dimmer on-times and corresponding power control signal values for generating the low end light output level may populate a second look-up table. For purposes of discussion, Table 1 provides an example of the first look-up table, including empirically gathered associations between high end dimmer on-times and power control signal values that result in 500 lumens output by the solid state lighting load 240:

TABLE 1

| Dimmer On-Time | Power Control Signal | Lumens Out |
|---|---|---|
| 7.0 ms | 90% | 500 |
| 7.2 ms | 87% | 500 |
| 7.4 ms | 82% | 500 |
| 7.6 ms | 80% | 500 |
| 7.8 ms | 78% | 500 |
| 8.0 ms | 76% | 500 |
| 8.2 ms | 74% | 500 |

Figure 1A:
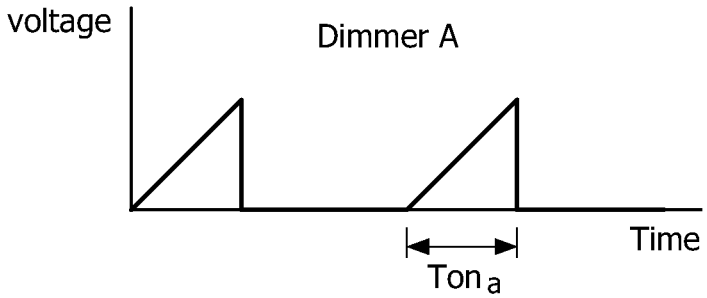
FIG. 1A PRIOR ART
FIGS. 1A-1B show waveforms of different conventional dimmers at respective minimum dimmer settings.
Figure 1B:
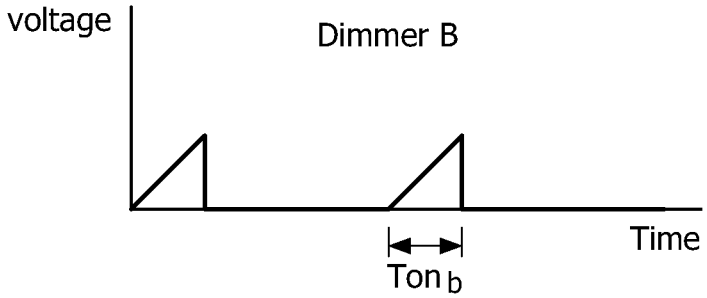
FIG. 1B PRIOR ART

As discussed above, dimmer on-time is the amount of time each chopped signal waveform of the rectified input mains voltage is non-zero (e.g., effectively corresponding to the amount of time the electronic switch of the dimmer is "on"), examples of which are shown by $Ton_a$ and $Ton_b$ in FIGS. 1A and 1B. Referring to the representative entries in Table 1, for example, a dimmer that outputs a signal waveform having an on-time of only 7.0 ms at its maximum setting requires a relatively large power control signal (e.g., having a 90 percent duty cycle) for the power converter 220 to drive the solid state lighting load 240 to output 500 lumens. In comparison, a dimmer that outputs a signal waveform having an on-time of 8.2 ms at its maximum setting requires a relatively small power control signal (e.g., having a 74 percent duty cycle) for the power converter 220 to drive the solid state lighting load 240 to output 500 lumens. Thus, for different values of the dimmer on-times (different RMS input voltages to the power converter 220), the power control signal may be adjusted so that the output level of light is a fixed high end value at the maximum dimmer setting.

Similarly, for purposes of discussion, Table 2 provides an example of the second look-up table including empirically gathered associations between low end dimmer on-times and power control signal values that result in 25 lumens output by the solid state lighting load 240:

TABLE 2

| Dimmer On-Time | Power Control Signal | Lumens Out |
|---|---|---|
| 1.0 ms | 16% | 25 |
| 1.2 ms | 14% | 25 |
| 1.4 ms | 12% | 25 |
| 1.6 ms | 10% | 25 |
| 1.8 ms | 8% | 25 |
| 2.0 ms | 6% | 25 |
| 2.2 ms | 4% | 25 |

Referring to the representative entries in Table 2, for example, a dimmer that outputs a signal waveform having an on-time of only 1.0 ms at its minimum setting requires a relatively large power control signal (e.g., having a 16 percent duty cycle) for the power converter 220 to drive the solid state lighting load 240 to output 25 lumens. In comparison, a dimmer that outputs a signal waveform having an on-time of 2.2 ms at its minimum setting requires a relatively small power control signal (e.g., having a 4 percent duty cycle) for the power converter 220 to drive the solid state lighting load 240 to output 25 lumens. Thus, for different values of the dimmer on-times (different RMS input voltages to the power converter 220), the power control signal may be adjusted so that the output level of light is a fixed low end value at the minimum dimmer setting.

The range of the on-times in Tables 1 and 2 may respectively encompass the known spreads of high end on-times and low end on-times of the dimmers specified for a particular product (solid state lighting load 240). In various embodiments, Tables 1 and 2 may be stored in the dimmer phase angle detection circuit 210, so that for a specific high end or low end dimmer on-time, the correct power control signal value is determined and provided to the power converter 220 to produce the prescribed high end or low end light output level. Also, although representative Tables 1 and 2 show dimmer on-times to indicate the level of dimming set by the dimmer, it is understood that Tables 1 and 2 could alternatively show dimmer phase angles to indicate the level of dimming set by the dimmer, without departing from the scope of the present teachings.

Referring again to FIG. 3, in block S320, the solid state lighting load 240 is connected to the dimmer 204, along with the dimmer phase angle detection circuit 210 and the power converter 220, and operated using different dimmer settings of the dimmer 204. During this operation, maximum and minimum phase angles associated with the dimmer 204 are determined by the process depicted by block S330. The determination of the maximum and minimum phase angles may be accomplished by dynamically detecting the various dimmer phase angles, and identifying the largest and smallest of the detected phase angles (e.g., having the longest and shortest dimmer on-times, respectively) as the maximum and minimum phase angles.

Figure 4:
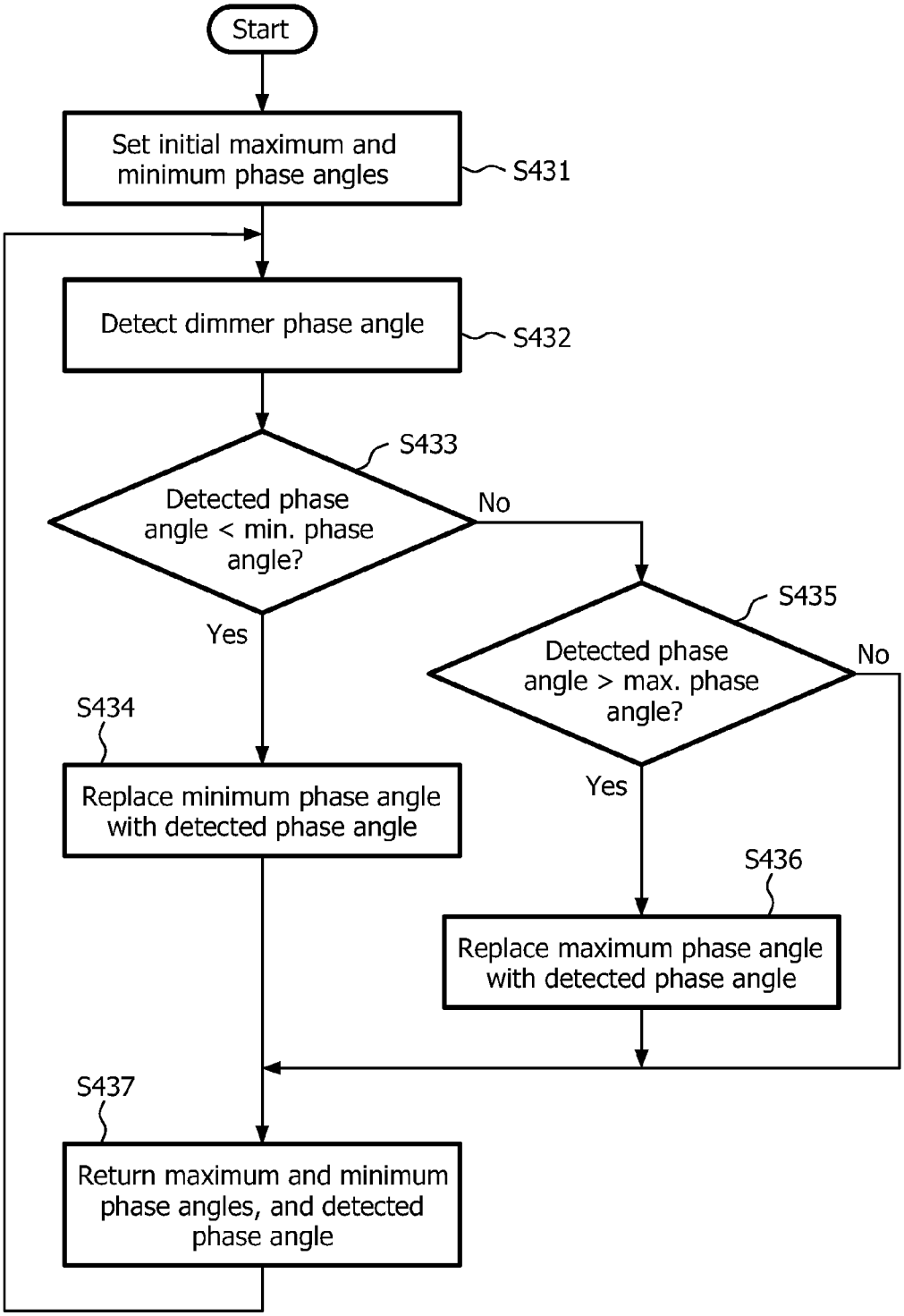
FIG. 4 is a flow diagram showing a process of determining maximum and minimum phase angles of a dimmer, according to a representative embodiment.

FIG. 4 is a flow diagram showing a process of determining the maximum and minimum phase angles of a dimmer, according to a representative embodiment. The process may be implemented, for example, by firmware and/or software executed by dimmer phase angle detection circuit 210 shown in FIG. 2, or by microcontroller 615 of FIG. 6, discussed below.

Referring to FIG. 4, an initial maximum phase angle and an initial minimum phase angle of the dimmer 204 are set in block S431 to begin the process. The initial maximum and minimum phase angles may be set to predetermined nominal values. For example, the initial maximum and minimum phase angles may be set to a previously calculated average maximum phase angle and average minimum phase angle of a sampling of dimmers that are compatible with the solid state lighting load 240. Alternatively, the initial maximum and minimum phase angles may be set to arbitrarily determined high and low values. Also, the initial maximum and minimum phase angles may be retrieved from memory, in which they were stored following prior operation of the lighting system 200, which may avoid having to recalculate the actual maximum and minimum phase angles during every operation of the solid state lighting load 240.

In block S432, the dimmer phase angle is determined. For example, the phase angle may be detected according to the algorithm depicted in FIG. 8, discussed below, or retrieved from memory (e.g., in which the phase angle information was stored in block S827 of FIG. 8). In various embodiments, the dimmer phase angle is determined throughout operation of the lighting system 200, so that any changes in the dimmer phase angle, in response to changes in the setting of the dimmer 204, are detected and processed.

It is determined in block S433 whether the detected phase angle is less than the current minimum phase angle (e.g., which is the initial minimum phase angle during at least the first cycle). When the currently detected phase angle is determined to be less than the minimum phase angle (block S433: Yes), the previous minimum phase angle is replaced with the currently detected phase angle in block S434. When the currently detected phase angle is determined not to be less than the minimum phase angle (block S433: No), the process proceeds to block S435, in which it is determined whether the detected phase angle is greater than the current maximum phase angle (e.g., the initial maximum phase angle during at least the first cycle).

When the currently detected phase angle is determined to be greater than the maximum phase angle (block S435: Yes), the previous maximum phase angle is replaced with the currently detected phase angle in block S436. When the currently detected phase angle is determined not to be greater than the minimum phase angle (block S435: No), the process proceeds to block S437. Of course, in alternative embodiments, the determination of whether the detected phase angle is greater than the current maximum phase angle may be performed before or simultaneously with the determination of whether the detected phase angle is less than the current minimum phase angle, without departing from the scope of the present teachings.

In block S437, the maximum and minimum phase angles of the dimmer, as well as the detected phase angle, are returned to the process depicted in FIG. 3. In various embodiments, the maximum and minimum phase angles may be returned to the process depicted in FIG. 3 only when changes have been made to the minimum and/or maximum phase angles. Otherwise, the process depicted in FIG. 3 continues using the initial or most recently determined maximum and minimum phase angles. The detected dimmer phase angle is returned so that the power control signal value can be determined to control the output power of the power converter 220 using a function determined from the maximum and minimum phase angles, as discussed below.

Meanwhile, the phase angle detection process of FIG. 4 continues by returning to block S432, where the dimmer phase angle is again detected. Blocks S433 through S437 are repeated throughout operation of the lighting system. Eventually, the dimmer 204 will be set to its highest and lowest dimmer settings, and the corresponding actual maximum and minimum phase angles will be identified. However, the dimmer phase angle detection circuit 210 will continue to generate power control signals corresponding to detected dimmer phase angles, as discussed below, so that dimming control may be performed on some level, before, during and after the actual maximum and minimum phase angles have been determined.

Referring again to FIG. 3, in block S340, the power control signal values corresponding to maximum and minimum phase angles detected in the process of block S330 are identified. This may be accomplished using the relationships between phase angles and power control signal values determined in block S310. For example, the maximum and minimum phase angles have corresponding high end and low end on-times, which populate previously stored first and second tables, as discussed above. For purposes of discussion, it may be assumed that the high end on-time has been determined to be 8.0 ms and the low end on-time has been determined to be 1.4 ms, for example. Referring to Table 1, the power control signal value corresponding to the high end on-time of 8.0 ms is 76 percent (to yield a light output level of 500 lumens), and referring to Table 2, the power control signal value corresponding to the low end on-time of 1.4 ms is 12 percent (to yield a light output level of 25 lumens).

In block S350, a function, representing the dimming range of light output by the solid state lighting load 240 between high and low end points corresponding to maximum and minimum dimmer settings, is determined using the minimum and maximum phase angles (high and low on-times) and the corresponding power control signal values. Generally, any of a variety of functions relating power control signal values to dimmer phase angles (or on-times) may be used in various embodiments, depending on application specific design requirements and desired implementations, as would be apparent to one of ordinary skill in the art, so long as the function has no large steps to avoid large steps in the light output by the solid state lighting load 240.

Figure 5A:
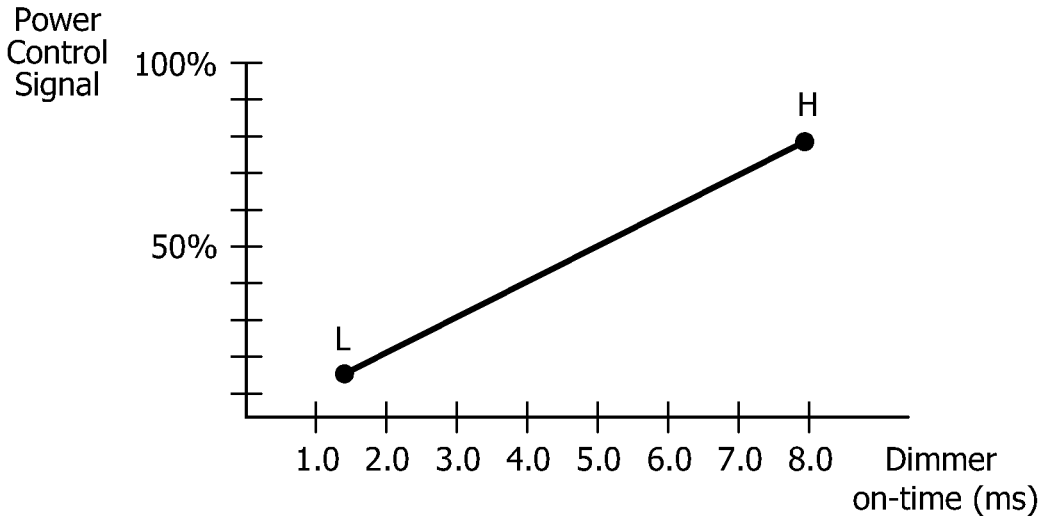
FIGS. 5A-5B are graphs showing dimmer phase angles versus power control signal values between high and low endpoints, according to a representative embodiment.
Figure 5B:
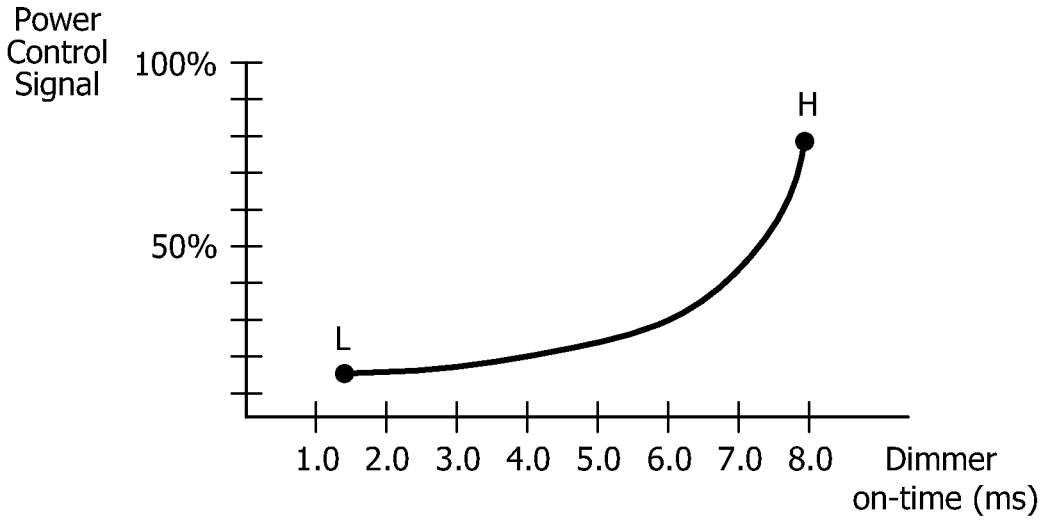

FIGS. 5A and 5B show examples of "smooth" or substantially continuous functions relating the power control signal values (vertical axis) and dimmer on-times (horizontal axis), where FIG. 5A shows a linear function and FIG. 5B shows a non-linear function. For purposes of discussion, it may again be assumed that the high end on-time and corresponding power control signal value have been determined to be 8.0 ms and 76 percent, and that the low end on-time and corresponding power control signal value have been determined to be 1.4 ms and 12 percent, for example. By correctly setting the high end point H and the low end point L of the function on a per dimmer basis, the high and low light levels corresponding to the high end point H and the low end point L can be made the same from dimmer to dimmer.

Although both FIGS. 5A and 5B show dimmer on-time in milliseconds, for purposes of explanation, it is understood that each of the on-time values has a corresponding dimmer phase angle, as discussed above, such that the low end on-time (e.g., 1.4 ms) has a corresponding minimum phase angle and the high end on-time (e.g., 8.0 ms) has a corresponding maximum phase angle. Also, any function may be used to set a desired dimming range of light output by the solid state lighting load 240, as long as it is smooth and without large steps.

In block S360 of FIG. 3, a power control signal is calculated and generated based on the light output range function determined in block S350. Of course, if the dimmer phase angle detected in the process of block S330 (e.g., in block S432) is determined to be a maximum phase angle or a minimum phase angle, then the corresponding power control signal value is already known (e.g., from the first and second look-up tables). However, for detected dimmer phase angles between the maximum and minimum phase angles (interim dimmer phase angles), the value of power control signal is adjusted by the dimmer phase angle detection circuit 210, based on the function, such that the interim dimmer phase angles result in corresponding interim levels of light output by the solid state lighting load 240. In other words, in the examples depicted in FIGS. 5A and 5B, each of the interim dimmer phase angles may be plotted along the linear or non-linear curve, as a function of the detected dimmer phase angle (or dimmer on-time).

The dimmer phase angle detection circuit 210 sends the power control signal to the power converter 220. In response, the operating point of the power converter 220 is set, and the power converter 220 delivers power to the solid state lighting load 240 corresponding to the RMS input voltage and the power control signal, so that a uniformly dimmed level of light is output by the solid state lighting load 240 regardless of the type of dimmer.

Thus, according to various embodiments, the dimmer phase angle detection circuit 210 is configured to identify the maximum and minimum phase angles of the dimmer 204, and to output power control signals that control the power converter 220, such that the solid state lighting load 240 outputs a predetermined high level of light in response to the maximum phase angle and a predetermined low level of light in response to the minimum phase angle. The dimmer phase angle detection circuit 210 also outputs power control signals corresponding to detected interim dimmer phase angles in between the maximum and minimum phase angles based on a light output range function, which may be linear or non-linear. The dimmer phase angle detection circuit 210 outputs the power control signal, e.g., via a control line 229, to the power converter 220, which dynamically adjusts the operating point of the power converter 220, as discussed above. Thus, the power delivered to the solid state lighting load 240 is determined by the RMS input voltage and the power control signal.

Figure 6:
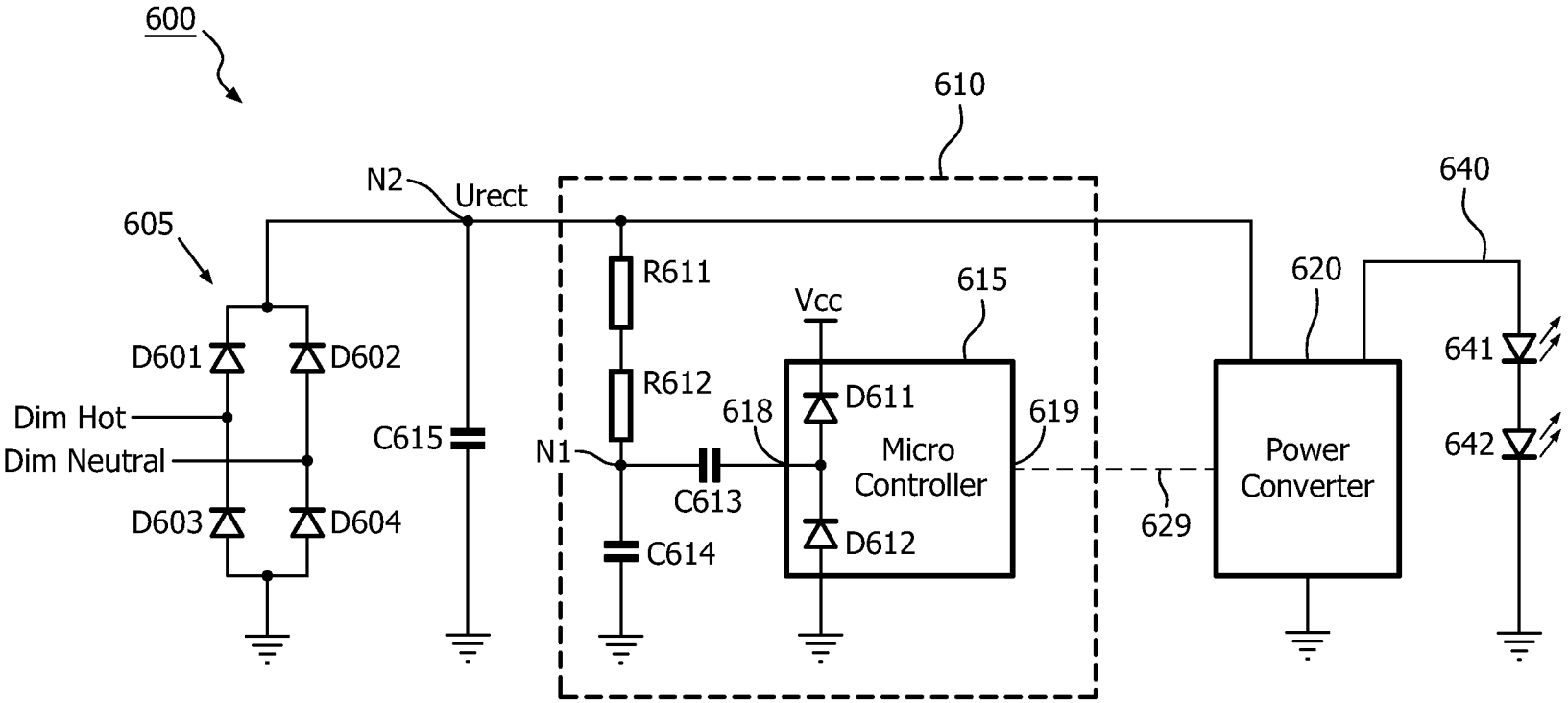
FIG. 6 is a circuit diagram showing a control circuit for a lighting system, according to a representative embodiment.

FIG. 6 is a circuit diagram showing a control circuit for a lighting system, including a dimmer phase angle detection circuit, a power converter and a solid state lighting fixture, according to a representative embodiment. The general components of FIG. 6 are similar to those of FIG. 2, although more detail is provided with respect to various representative components, in accordance with an illustrative configuration. Of course, other configurations may be implemented without departing from the scope of the present teachings.

Referring to FIG. 6, control circuit 600 includes rectification circuit 605 and dimmer phase angle detection circuit 610 (dashed box). As discussed above with respect to the rectification circuit 205, the rectification circuit 605 is connected to a dimmer connected between the rectification circuit 605 and the voltage mains to receive (dimmed) unrectified voltage, indicated by the dimmed hot and neutral inputs. In the depicted configuration, the rectification circuit 605 includes four diodes D601-D604 connected between rectified voltage node N2 and ground. The rectified voltage node N2 receives the rectified voltage Urect, and is connected to ground through input filtering capacitor C615 connected in parallel with the rectification circuit 605.

The dimmer phase angle detection circuit 610 performs a phase angle detection process based on the rectified voltage Urect. The phase angle corresponding to the level of dimming set by the dimmer is detected based on the extent of phase chopping present in a signal waveform of the rectified voltage Urect. The dimmer phase angle detection circuit 610 determines whether the detected phase angle is a maximum or minimum phase angle with respect to the particular dimmer, and generates a power control signal based on the detected phase angle, as discussed above. The power converter 620 controls operation of the LED load 640, which includes representative LEDs 641 and 642 connected in series, based on the rectified voltage Urect (RMS input voltage) and the power control signal provided by the dimmer phase angle detection circuit 610. This allows the dimmer phase angle detection circuit 610 to adjust selectively the power delivered from the power converter 620 to the LED load 640, so that the level of light output by the LED load 640 is substantially uniform for the same dimmer setting (including the high end and low end settings) among a variety of different types of dimmers. In various embodiments, the power converter 620 operates in an open loop or feed-forward fashion, as described in U.S. Pat. No. 7,256,554 to Lys, for example, which is hereby incorporated by reference.

In the depicted representative embodiment, the dimmer phase angle detection circuit 610 includes microcontroller 615, which uses signal waveforms of the rectified voltage Urect to determine the phase angle. The microcontroller 615 includes digital input 618 connected between a first diode D611 and a second diode D612. The first diode D611 has an anode connected to the digital input 618 and a cathode connected to voltage source Vcc, and the second diode D612 has an anode connected to ground and a cathode connected to the digital input 618. The microcontroller 615 also includes the digital output 619.

In various embodiments, the microcontroller 615 may be a PIC12F683 processor, available from Microchip Technology, Inc., and the power converter 620 may be an L6562, available from ST Microelectronics, for example, although other types of microcontrollers, power converters, or other processors and/or controllers may be included without departing from the scope of the present teachings. For example, the functionality of the microcontroller 615 may be implemented by one or more processors and/or controllers, connected to receive digital input between first and second diodes D611 and D612 as discussed above, and which may be programmed using software or firmware (e.g., stored in a memory) to perform the various functions described herein, or may be implemented as a combination of dedicated hardware to perform some functions and a processor (e.g., one or more programmed microprocessors and associated circuitry) to perform other functions. Examples of controller components that may be employed in various embodiments include, but are not limited to, conventional microprocessors, microcontrollers, ASICs and FPGAs, as discussed above.

The dimmer phase angle detection circuit 610 further includes various passive electronic components, such as first and second capacitors C613 and C614, and a resistance indicated by representative first and second resistors R611 and R612. The first capacitor C613 is connected between the digital input 618 of the microcontroller 615 and a detection node N1. The second capacitor C614 is connected between the detection node N1 and ground. The first and second resistors R611 and R612 are connected in series between the rectified voltage node N2 and the detection node N1. In the depicted embodiment, the first capacitor C613 may have a value of about 560 pF and the second capacitor C614 may have a value of about 10 pF, for example. Also, the first resistor R611 may have a value of about 1 megohm and the second resistor R612 may have a value of about 1 megohm, for example. However, the respective values of the first and second capacitors C613 and C614, and the first and second resistors R611 and R612 may vary to provide unique benefits for any particular situation or to meet application specific design requirements of various implementations, as would be apparent to one of ordinary skill in the art.

The rectified voltage Urect is AC coupled to the digital input 618 of the microcontroller 615. The first resistor R611 and the second resistor R612 limit the current into the digital input 618. When a signal waveform of the rectified voltage Urect goes high, the first capacitor C613 is charged on the rising edge through the first and second resistors R611 and R612. The first diode D611 clamps the digital input 618 one diode drop above the voltage source Vcc, for example, while the first capacitor C613 is charged. The first capacitor C613 remains charged as long as the signal waveform is not zero. On the falling edge of the signal waveform of the rectified voltage Urect, the first capacitor C613 discharges through the second capacitor C614, and the digital input 618 is clamped to one diode drop below ground by the second diode D612. When a trailing edge dimmer is used, the falling edge of the signal waveform corresponds to the beginning of the chopped portion of the waveform. The first capacitor C613 remains discharged as long as the signal waveform is zero. Accordingly, the resulting logic level digital pulse at the digital input 618 closely follows the movement of the chopped rectified voltage Urect, examples of which are shown in FIGS. 7A-7C.

Figure 7A:
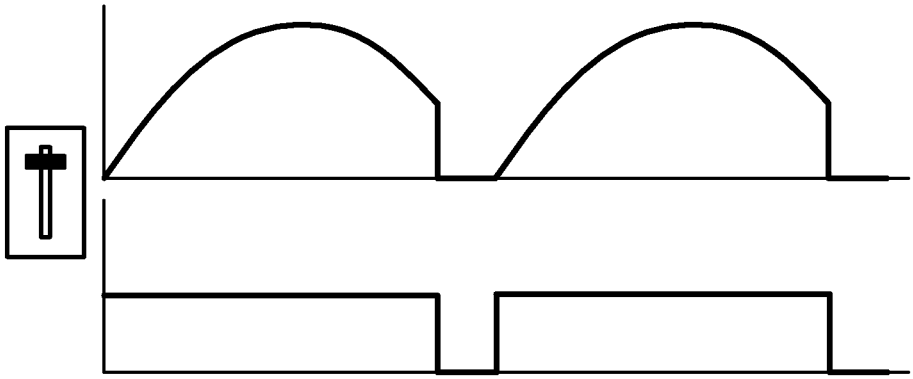
FIGS. 7A-7C show sample waveforms and corresponding digital pulses of a dimmer, according to a representative embodiment.
Figure 7B:
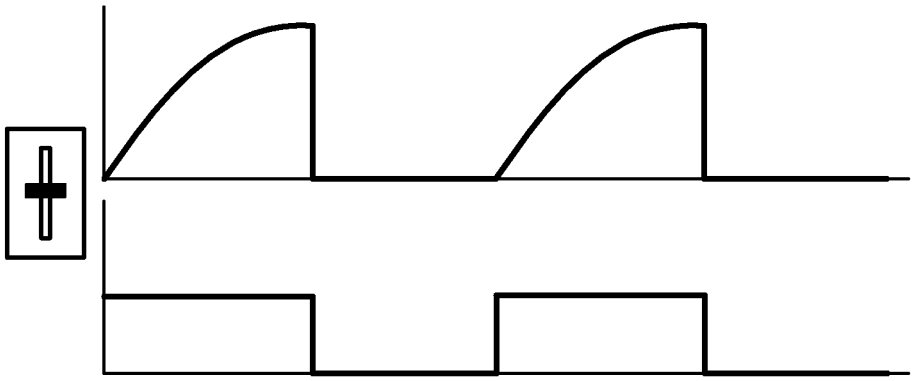
Figure 7C:
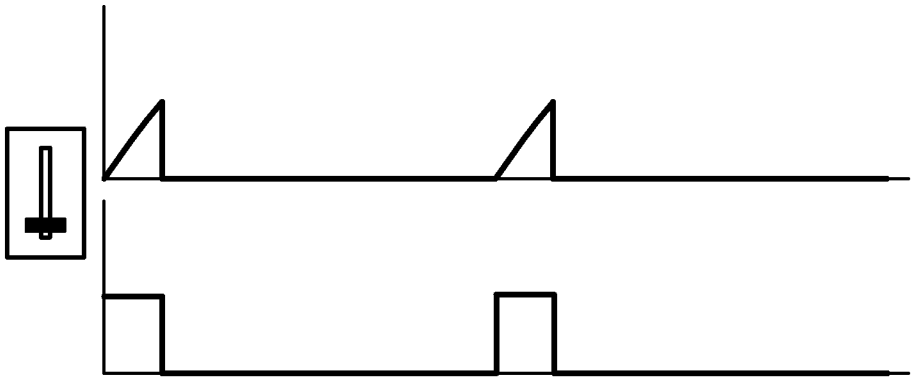

More particularly, FIGS. 7A-7C show sample waveforms and corresponding digital pulses at the digital input 618, according to representative embodiments. The top waveforms in each figure depict the chopped rectified voltage Urect, where the amount of chopping reflects the level of dimming. For example, the waveforms may depict a portion of a full 170V (or 340V for E.U.) peak, rectified sine wave that appears at the output of the dimmer. The bottom square waveforms depict the corresponding digital pulses seen at the digital input 618 of the microcontroller 615. Notably, the length of each digital pulse corresponds to a chopped waveform, and thus is equal to the dimmer on-time (e.g., the amount of time the dimmer's internal switch is "on"). By receiving the digital pulses via the digital input 618, the microcontroller 615 is able to determine the level to which the dimmer has been set.

FIG. 7A shows sample waveforms of rectified voltage Urect and corresponding digital pulses when the dimmer is at its maximum setting or high end on-time, indicated by the top position of the dimmer slider shown next to the waveforms. FIG. 7B shows sample waveforms of rectified voltage Urect and corresponding digital pulses when the dimmer is at a medium setting, indicated by the middle position of the dimmer slider shown next to the waveforms. FIG. 7C shows sample waveforms of rectified voltage Urect and corresponding digital pulses when the dimmer is at its minimum setting or low end on-time, indicated by the bottom position of the dimmer slider shown next to the waveforms.

Figure 8:
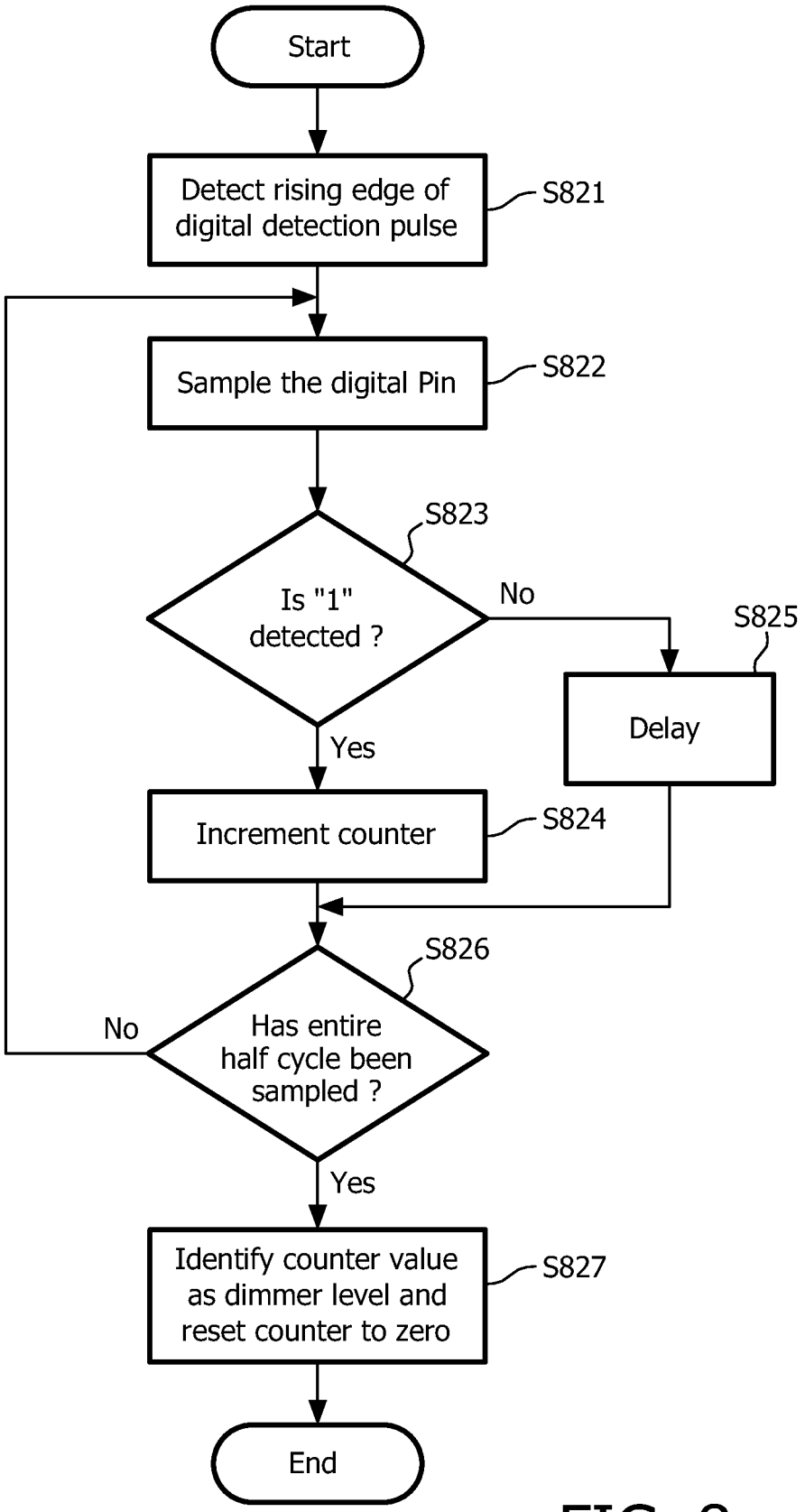
FIG. 8 is a flow diagram showing a process of detecting phase angles, according to a representative embodiment.

FIG. 8 is a flow diagram showing a process of detecting the phase angle of a dimmer, according to a representative embodiment. The process may be implemented by firmware and/or software executed by the microcontroller 615 shown in FIG. 6, or more generally by a processor or controller, e.g., the dimmer phase angle detection circuit 210 shown in FIG. 2, for example.

In block S821 of FIG. 8, a rising edge of a digital pulse of an input signal (e.g., indicated by rising edges of the bottom waveforms in FIGS. 7A-7C) is detected, for example, by initial charging of the first capacitor C613. Sampling at the digital input 618 of the microcontroller 615, for example, begins in block S822. In the depicted embodiment, the signal is sampled digitally for a predetermined time equal to just under a mains half cycle. Each time the signal is sampled, it is determined in block S823 whether the sample has a high level (e.g., digital "1") or a low level (e.g., digital "0"). In the depicted embodiment, a comparison is made in block S823 to determine whether the sample is digital "1." When the sample is digital "1" (block S823: Yes), a counter is incremented in block S824, and when the sample is not digital "1" (block S823: No), a small delay is inserted in block S825. The delay is inserted so that the number of clock cycles (e.g., of the microcontroller 615) is equal regardless of whether the sample is determined to be digital "1" or digital "0."

In block S826, it is determined whether the entire mains half cycle has been sampled. When the mains half cycle is not complete (block S826: No), the process returns to block S822 to again sample the signal at the digital input 618. When the mains half cycle is complete (block S826: Yes), the sampling stops and the counter value accumulated in block S824 is identified as the current phase angle in block S827, and the counter is reset to zero. The counter value may be stored in a memory, examples of which are discussed above. The microcontroller 615 may then wait for the next rising edge to begin sampling again.

For example, it may be assumed that the microcontroller 615 takes 255 samples during a mains half cycle. When the dimmer phase angle is set by the slider at the top of its range (e.g., as shown in FIG. 7A), the counter will increment to about 255 in block S824 of FIG. 8. When the dimmer phase angle is set by the slider at the bottom of its range (e.g., as shown in FIG. 7C), the counter will increment to only about 10 or 20 in block S824. When the dimmer phase angle is set somewhere in the middle of its range (e.g., as shown in FIG. 7B), the counter will increment to about 128 in block S824. The value of the counter thus gives the microcontroller 615 an accurate indication of the level to which the dimmer has been set or the phase angle of the dimmer. In various embodiments, the phase angle may be calculated, e.g., by the microcontroller 615, using a predetermined function of the counter value, where the function may vary in order to provide unique benefits for any particular situation or to meet application specific design requirements of various implementations, as would be apparent to one of ordinary skill in the art.

Accordingly, as discussed above, high end and low end on-times of a particular dimmer may be electronically detected, using minimal passive components and a digital input structure of a microcontroller (or other processor or processing circuit), and the high end and low end on-times may be used to adjust dynamically the levels of light output by a solid state lighting load, so that the levels of light are substantially uniform (particularly and the highest and lowest dimmer settings) for multiple different types of dimmers. In an embodiment, dimmer detection is accomplished using an AC coupling circuit, a microcontroller diode clamped digital input structure and an algorithm (e.g., implemented by firmware, software and/or hardware) executed for binary determination of dimmer presence, as discussed above with reference to FIGS. 6-8.

In other words, according to various embodiments, the high and low end points of a light output range function are determined on the fly by first finding the maximum and minimum dimmer phase angles. Then, corresponding power control signal values are identified, e.g., looked up in a table, retrieved from a relational database or calculated, using the maximum and minimum dimmer phase angles, in order to set the desired high and low end light levels output by the solid state lighting load, independent of the actual dimming range of the dimmer. The light output range function may be a smooth, substantially continuous function, for example, providing incrementally increasing power control signal values corresponding to the dimmer phase angles between the high and low end points.

The dimmer phase angle detection circuit and associated algorithm may be used in various situations where it is desired that different dimmers having different high and low end dimmer settings results in substantially the same dimming ranges when used with the same lighting products. In various embodiments, the dimmer phase angle detection circuit and associated algorithm also may be used in situations where it is further desired to know the exact phase angle of a phase chopping dimmer. For example, electronic transformers which run as a load to a phase chopping dimmer can use this circuit and method to determine the dimmer phase angle. Once the dimmer phase angle is known, the range of dimming and compatibility with dimmers with respect to solid state lighting fixtures (e.g. LEDs) may be improved. Examples of such improvements include controlling the color temperature of a lamp with dimmer setting, determining the minimum load a dimmer can handle in situ, determining when a dimmer behaves erratically in situ, altering ranges of light output, and creating custom dimming light to slider position curves.

Generally, the various embodiments may be used in situations where a dimmable electronic ballast is connected to a dimmer, and it is desirable to have the same levels of light output at the maximum and minimum dimmer settings regardless of the type of dimmer being used. In various embodiments, the functionality of the dimmer phase angle detection circuit 210 and/or the microcontroller 615, for example, may be implemented by one or more processing circuits, constructed of any combination of hardware, firmware or software architectures, and may include its own memory (e.g., nonvolatile memory) for storing executable software/firmware executable code that allows it to perform the various functions. For example, the functionality may be implemented using ASICs, FPGAs, and the like.

The method for making the light output range the same from dimmer to dimmer can be used with any dimmable power converter with a solid state lighting (e.g., LED) load where it is desired to have the same optimal performance in light output range, while using a variety of phase chopping dimmers with different minimum and maximum dimmer settings. The dimmer phase angle detection circuit, according to various embodiments, may be implemented in various EssentialWhite™ and/or eW products available from Philips Color Kinetics, including eW Blast PowerCore, eW Burst PowerCore, eW Cove MX PowerCore, eW PAR 38, and the like. Further, it may be used as a building block of "smart" improvements to various products to make them more dimmer-friendly.

While multiple inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used.

Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein All definitions, as defined and used herein, should be understood to control over dictionary definitions, definitions in documents incorporated by reference, and/or ordinary meanings of the defined terms.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited. Also, any reference numerals or other characters, appearing between parentheses in the claims, are provided merely for convenience and are not intended to limit the claims in any way, In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

The invention claimed is:

1. A method of controlling a power converter to provide a uniform dimming range to a solid state lighting load independent of a type of dimmer, the method comprising:

determining maximum and minimum phase angles of a dimmer connected to the power converter during operation of the solid state lighting load by detecting a plurality of dimmer phase angles based on rectified input mains voltages and comparing the detected phase angles with a previously determined minimum phase angle and a previously determined maximum phase angle; and dynamically adjusting an output power of the power converter based on the detected maximum and minimum phase angles of the dimmer, the adjusted output power of the power converter adjusting a high end level of light output by the solid state lighting load at the maximum phase angle to match a predetermined high end value and adjusting a low end level of light output by the solid state lighting load at the minimum phase angle to match a predetermined low end value.

2. The method of claim 1, wherein the step of determining the maximum and minimum dimmer phase angles comprises:

detecting a plurality of dimmer phase angles based on rectified input mains voltages;

comparing the detected phase angles with a previously determined minimum phase angle and a previously determined maximum phase angle;

setting a detected phase angle as the minimum phase angle when the detected phase angle is less than the previously determined minimum phase angle; and setting a detected phase angle as the maximum phase angle when the detected phase angle is greater than the previously determined maximum phase angle.

3. The method of claim 2, wherein the step of dynamically adjusting an output power of the power converter comprises:

determining a function relating values of a power control signal of the power converter and dimmer phase angles, using the minimum phase angle to determine a low end point of the function corresponding to the low end level of light output by the solid state lighting load, and using the maximum phase angle to determine a high end point of the function corresponding to the high end level of light output by the solid state lighting load.

4. The method of claim 3, further comprising:

determining a value of the power control signal for adjusting the output power of the power converter to the solid state lighting load based on the function and a detected phase angle.

5. A method for providing a uniform dimming range of a solid state lighting load for a plurality of different types of dimmers, the method comprising:

initially setting a minimum phase angle corresponding to a minimum dimmer setting and a maximum phase angle corresponding to maximum minimum dimmer setting;

detecting a dimmer phase angle based on a rectified input mains voltage;

determining whether the detected phase angle is less than the initial minimum phase angle;

setting the detected phase angle as the minimum phase angle when the detected phase angle is less than the initial minimum phase angle;

determining whether the detected phase angle is greater than the initial maximum phase angle;

setting the detected phase angle as the maximum phase angle when the detected phase angle is greater than the initial maximum phase angle; and determining a light output range function from the minimum phase angle and the maximum phase angle for determining a value of a power control signal, the power control signal controlling an output power delivered by a power converter to the solid state lighting load, such that the solid state lighting load outputs a predetermined minimum light level in response to the minimum phase angle and outputs a predetermined maximum light level in response to the maximum phase angle.

6. The method of claim 5, further comprising:

setting the value of the power control signal by applying the detected phase angle to the light output range function.

7. The method of claim 5, wherein the light output range function comprises a function defining a curve between a low end time-on value corresponding to the minimum phase angle and a high end time-on value corresponding to the maximum phase angle.

8. The method of claim 7, wherein the light output range function comprises a linear function.

9. The method of claim 5, wherein initially setting the minimum phase angle comprises:

determining a minimum phase angle corresponding to each of the plurality of different types of dimmers;

calculating an average minimum phase angle based on the determined minimum phase angle corresponding the plurality of different types of dimmers; and setting the initial minimum phase angle to the calculated average minimum phase angle.

10. The method of claim 5, wherein initially setting the maximum phase angle comprises:

determining a maximum phase angle corresponding to each of the plurality of different types of dimmers;

calculating an average maximum phase angle based on the determined maximum phase angle corresponding the plurality of different types of dimmers; and setting the initial maximum phase angle to the calculated average maximum phase angle.

11. The method of claim 5, wherein the power control signal comprises a pulse width modulation (PWM) signal and the value of the power control signal comprises a percentage duty cycle.

12. The method of claim 5, further comprising:

building a first look-up table associating a plurality of first dimmer phase angles with a plurality of values of power control signals that respectively cause the solid state lighting load to output the predetermined minimum light level at the corresponding dimmer phase angles; and building a second look-up table associating a plurality of second dimmer phase angles with a plurality of values of power control signals that respectively cause the solid state lighting load to output the predetermined maximum light level at the corresponding dimmer phase angles.

13. The method of claim 12, wherein determining the light output range function comprises:

associating the minimum phase angle with a selected first dimmer phase angle of the plurality of first dimmer phase angles in the first look-up table;

retrieving a selected first value of the power control signal corresponding to the selected first dimmer phase angle from the first look-up table; and identifying a low end point of the light output range function as a point corresponding to the selected first dimmer phase angle and the selected first value of the power control signal.

14. The method of claim 13, wherein determining the light output range function further comprises:

associating the maximum phase angle with a selected second dimmer phase angle of the plurality of second dimmer phase angles in the second look-up table;

retrieving a selected second value of the power control signal corresponding to the selected second dimmer phase angle from the first look-up table; and identifying a high end point of the light output range function as a point corresponding to the selected second dimmer phase angle and the selected second value of the power control signal.

* * * * *